US008959860B2

(12) United States Patent
Wierzbowski

(10) Patent No.: US 8,959,860 B2
(45) Date of Patent: Feb. 24, 2015

(54) EXPANSION JOINT COVER ASSEMBLY FOR STRUCTURAL MEMBERS

(75) Inventor: Chris Wierzbowski, Cheektowaga, NY (US)

(73) Assignee: Construction Research & Technology GmbH, Trostberg (DE)

( * ) Notice: Subject to any disclaimer, the term of this patent is extended or adjusted under 35 U.S.C. 154(b) by 0 days.

(21) Appl. No.: 13/347,369

(22) Filed: Jan. 10, 2012

(65) Prior Publication Data

US 2012/0180417 A1 Jul. 19, 2012

Related U.S. Application Data

(60) Provisional application No. 61/431,930, filed on Jan. 12, 2011.

(51) Int. Cl.
*E04B 1/686* (2006.01)
*E04B 1/68* (2006.01)

(52) U.S. Cl.
CPC ..... *E04B 1/681* (2013.01)
USPC ..... 52/396.05; 52/395; 52/461

(58) Field of Classification Search
USPC ..... 52/395, 396.05, 461
See application file for complete search history.

(56) References Cited

U.S. PATENT DOCUMENTS

| | | | | |
|---|---|---|---|---|
| 3,363,522 | A | | 1/1968 | Galbreath |
| 3,435,574 | A | | 4/1969 | Hallock |
| 3,659,390 | A | | 5/1972 | Balzer et al. |
| 3,696,575 | A | | 10/1972 | Armstrong |
| 3,745,726 | A | | 7/1973 | Thom |
| 3,758,220 | A | * | 9/1973 | Hein ..... 404/67 |
| 3,810,707 | A | | 5/1974 | Tungseth et al. |
| 3,849,958 | A | | 11/1974 | Balzer et al. |
| 3,862,810 | A | * | 1/1975 | Welch ..... 404/66 |
| 3,899,261 | A | * | 8/1975 | Mieville ..... 404/68 |
| 3,974,609 | A | | 8/1976 | Attaway |
| 3,974,614 | A | | 8/1976 | Strong |
| 3,996,713 | A | * | 12/1976 | Haeussler ..... 52/309.12 |
| 4,022,538 | A | * | 5/1977 | Watson et al. ..... 404/69 |
| 4,067,155 | A | | 1/1978 | Ruff et al. |
| 4,111,582 | A | | 9/1978 | Tippett |
| 4,184,298 | A | | 1/1980 | Balzer et al. |

(Continued)

FOREIGN PATENT DOCUMENTS

| | | |
|---|---|---|
| JP | 6322848 | 11/1994 |
| JP | 6322849 | 11/1994 |

*Primary Examiner* — Brian Glessner
*Assistant Examiner* — Joshua Ihezie
(74) *Attorney, Agent, or Firm* — Curatolo Sidoti Co., LPA; Joseph G. Curatolo; Salvatore A. Sidoti

(57) ABSTRACT

A bendable cover assembly for an expansion joint gap in a tread and riser application includes an elongated resilient cover for bridging a gap between underlying structural members. A plurality of spaced-apart rigid plate members are encapsulated within, or otherwise are engaged with, the elongated cover of the cover assembly. Additional bendable plate members may be positioned on opposite lateral sides of the plurality of spaced-apart rigid plate members. The cover has a thickness and sufficient elasticity to elastically deform for establishing supporting contact between the marginal support areas of the cover and the underlying structural members. Fasteners may be engaged with the cover at spaced apart sites along at least one lateral side portion thereof for elastically anchoring the elongated resilient cover to at least one of the underlying structural members.

41 Claims, 4 Drawing Sheets

(56) References Cited

U.S. PATENT DOCUMENTS

| | | | | | |
|---|---|---|---|---|---|
| 4,271,650 | A | | 6/1981 | Lynn-Jones | |
| 4,307,974 | A | * | 12/1981 | George | 404/68 |
| 4,654,245 | A | * | 3/1987 | Balzer et al. | 428/52 |
| 4,706,318 | A | | 11/1987 | Huber et al. | |
| 4,815,247 | A | | 3/1989 | Nicholas | |
| 4,876,759 | A | | 10/1989 | Yang | |
| 5,020,294 | A | | 6/1991 | Duda | |
| 5,024,554 | A | | 6/1991 | Benneyworth et al. | |
| 5,048,249 | A | | 9/1991 | Shreiner et al. | |
| 5,060,439 | A | | 10/1991 | Clements et al. | |
| 5,067,297 | A | | 11/1991 | Sobol | |
| 5,082,394 | A | | 1/1992 | George | |
| 5,092,094 | A | | 3/1992 | Duda et al. | |
| 5,211,505 | A | | 5/1993 | Ueda | |
| 5,263,293 | A | | 11/1993 | Gohlke et al. | |
| 5,269,624 | A | | 12/1993 | Kramer | |
| 5,644,879 | A | | 7/1997 | Shreiner et al. | |
| 5,791,111 | A | | 8/1998 | Beenders | |
| 5,799,456 | A | * | 9/1998 | Shreiner et al. | 52/396.04 |
| 5,887,400 | A | | 3/1999 | Bratek et al. | |
| 5,888,017 | A | | 3/1999 | Corrie | |
| 5,911,662 | A | | 6/1999 | Hallsten | |
| 6,112,488 | A | | 9/2000 | Olson et al. | |
| 6,167,667 | B1 | * | 1/2001 | Balaban | 52/395 |
| 6,751,918 | B2 | * | 6/2004 | Jesko | 52/393 |
| 6,751,919 | B2 | | 6/2004 | Calixto et al. | |
| 7,143,560 | B2 | * | 12/2006 | Jesko | 52/395 |

* cited by examiner

EXPANSION JOINT COVER ASSEMBLY FOR STRUCTURAL MEMBERS

CROSS REFERENCE TO RELATED APPLICATIONS

The present application claims the benefit, under 35 U.S.C. §119(e), of the filing date of U.S. Provisional Application Ser. No. 61/431,930, filed Jan. 12, 2011.

TECHNICAL FIELD

Disclosed is an expansion joint cover assembly for bridging a gap that is located between spaced-apart structural members.

BACKGROUND

An opening or gap is purposely provided between adjacent concrete structures for accommodating dimensional changes within the gap occurring as expansion and contraction due to temperature changes, changes in concrete structure dimensions, and seismic cycling and vibration. An expansion joint control system is conventionally installed in the gap to provide a bridge across the gap and to accommodate the movements occurring in the vicinity of the gap.

Expansion joint control systems are often used in open air structures, such as stadiums. The tread and riser applications in stadiums require the expansion joint control system to accommodate multi-directional movement resulting from seismic and thermal events, while still permitting egress across the expansion joint gap in the event of a seismic or thermal event during the sporting or entertainment event.

For tread and riser applications having cover plates, the contractor must field measure, cut and mitre each cover plate to match the dimensions of the tread and riser conditions. Measuring and cutting each cover plate of the tread and riser expansion control system is labor intensive and may result in waste of material in the event that the contractor does not make the proper measurements and cuts of the cover plate. The failure to properly mitre the cut cover plate sections may also result in the ingress of water and debris, thereby comprising the expansion control system and/or the underlying concrete structural member. Moreover, the failure to make the correct measurements and mitres may cause a trip hazard for pedestrians as they traverse the expansion control system.

Therefore, a need still exists in the art for an improved expansion joint cover assembly to bridge gaps or openings between structural members in a tread and riser application, which avoids the labor traditionally associated with having measure and cut each cover plate of the assembly to match the dimensions of the tread and riser conditions, which provides a smooth transition over the gap, which reduces the trip hazard for pedestrians, and which protects the underlying structural members.

Figure 1:
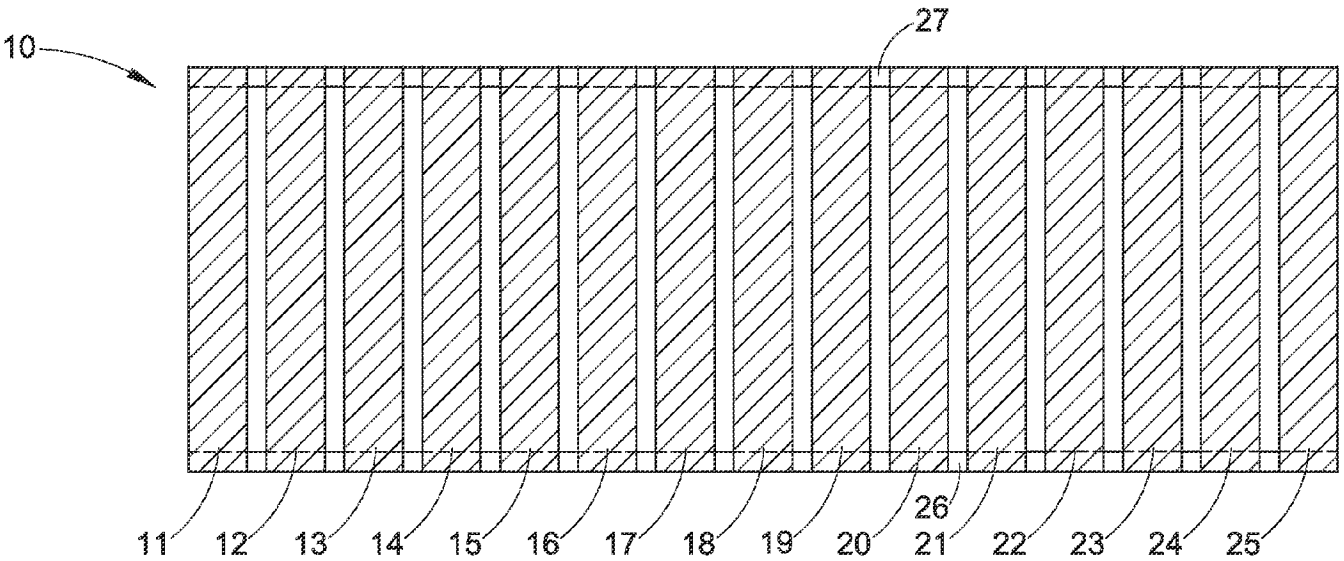
FIG. 1 is a top plan view of one illustrative embodiment of the expansion joint cover assembly.

Provided is an expansion joint cover assembly for bridging a gap between two spaced-apart underlying structural members. The expansion joint cover assembly is bendable, and may be bent in the field, to match the profile of a tread and riser condition. Because the expansion joint cover assembly is bendable, there is no need to make multiple measurements and cutting so the cover plates of the cover assembly to match the dimensions of the tread and riser condition. The bendable cover assembly includes a segmented center plate comprising a plurality of spaced-apart members. At least two of the plurality of spaced-apart members are connected together by a connecting member. By way of illustration, but not in limitation, the plurality of spaced-apart members are connected together by an elongated connector, such as a perforated metal or metal alloy strip. Because of the use of the segmented center plate and the perforated connecting members, the cover assembly can be bent by applying normal hand pressure. However, the construction provides sufficient strength to maintain the spaced-apart members of the segmented center plate from moving out of position inside the elongated cover.

The expansion joint cover assembly for a gap between two structural members comprises an elongated bendable cover, a plurality of spaced-apart rigid members engaged with said elongated bendable resilient cover, wherein said spaced-apart rigid members extend substantially transverse to the longitudinal axis of said elongated bendable cover and comprise a length sufficient to bridge said gap between said structural members, and at least one connecting member for connecting together at least two of said plurality of spaced-apart rigid members.

In certain embodiments, the elongated bendable resilient cover further comprises a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members.

In other embodiments, the elongated bendable resilient cover has a predetermined width sufficient to overlie portions of said structural members outwardly of marginal edges to a gap between said horizontal structural members.

In a further embodiment, the cover assembly further comprises plate members engaged with said elongated bendable cover and extending along opposite lateral sides of said plurality of rigid plate members.

In certain embodiments, the expansion joint cover assembly may elastically deform to apply a biasing force in a direction to urge opposite lateral sides of said cover toward the structural members while resiliently deformed by traffic traversing said traffic bearing surface.

In accordance with other embodiments, the expansion joint cover assembly may further comprise plate members extending along opposite lateral sides of said plurality of rigid plate members comprise a perforated metal, a perforated metal alloy, a perforated polymer material, or a perforated composite material.

In certain embodiments, the expansion joint cover assembly plate members extending along opposite lateral sides of said plurality of rigid plate members comprise a perforated metal alloy.

In other embodiments, the expansion joint cover assembly further comprises at least one fastener engaged with said cover along at least one lateral side portion of said cover for elastically anchoring said elongated resilient cover to at least one of the horizontal structural members.

The expansion joint cover assembly may further comprise a plurality of fasteners engaged with said cover at spaced apart sites along at least one lateral side portion of said cover for elastically anchoring said elongated resilient cover to at least one of the structural members.

In still further embodiments, the expansion joint cover assembly fasteners may comprise mechanical fasteners.

In other embodiments, the expansion joint cover assembly mechanical fasteners include at least one of nails, screws, rivets and/or tacks.

In accordance with other embodiments, the elongated resilient cover may further comprise thickened peripheral edges defining a border to a recessed face surface, said face surface supporting said rigid plate members.

In accordance with certain embodiments, the expansion joint cover assembly elongated bendable cover may further comprise thickened peripheral edges defining a border to a recessed face surface, said face surface supporting said plurality of spaced-apart rigid plate members, and said plate members extending along the opposite lateral sides of said plurality of spaced-apart rigid plate members.

In an embodiment, the expansion joint cover assembly may further comprise thickened peripheral edges that include tapered face surfaces for providing incline plates to bear traffic traversing the cover.

In other embodiments, the cover assembly load bearing surface may further comprise spaced apart upstanding ribs arranged to extend transversely to the direction of traffic traversing the cover.

According to certain embodiments, the expansion joint cover assembly for a gap between two structural members comprises an elongated bendable cover having a predetermined width sufficient to overlie portions of said structural members outwardly of marginal edges to a gap between said horizontal structural members, a plurality of spaced-apart rigid members engaged with said elongated bendable resilient cover, wherein said spaced-apart rigid members extend substantially transverse to the longitudinal axis of said elongated bendable cover and comprise a length sufficient to bridge said gap between said structural members, and at least one connecting member for connecting together at least two of said plurality of spaced-apart rigid members.

According to certain embodiments, the expansion joint cover assembly for a gap between two structural members comprises an elongated bendable cover having a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members, a plurality of spaced-apart rigid members encapsulated within said elongated bendable resilient cover, wherein said spaced-apart rigid members extend substantially transverse to the longitudinal axis of said elongated bendable cover and comprise a length sufficient to bridge said gap between said structural members, and at least one connecting member for connecting together at least two of said plurality of spaced-apart rigid members.

According to further embodiments, the expansion joint cover assembly for a gap between two structural members comprises an elongated bendable cover having a predetermined width sufficient to overlie portions of said structural members outwardly of marginal edges to a gap between said horizontal structural members, a plurality of spaced-apart rigid members encapsulated within said elongated bendable resilient cover, wherein said spaced-apart rigid members extend substantially transverse to the longitudinal axis of said elongated bendable cover and comprise a length sufficient to bridge said gap between said structural members, and at least one connecting member for connecting together at least two of said plurality of spaced-apart rigid members.

Also disclosed is an expansion joint comprising two spaced-apart structural members defining a gap therebetween and expansion joint cover assembly bridging said gap, the expansion joint cover assembly comprising an elongated bendable cover having a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members, a plurality of spaced-apart rigid members engaged with said elongated bendable resilient cover, wherein said spaced-apart rigid members extend substantially transverse to the longitudinal axis of said elongated bendable cover and comprise a length sufficient to bridge said gap between said structural members, and at least one connecting member for connecting together at least two of said plurality of spaced-apart rigid members.

According to certain embodiments, the expansion joint comprises two spaced-apart structural members defining a gap therebetween, and an expansion joint cover assembly bridging the gap, said expansion joint cover assembly comprising an elongated bendable cover having a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members, a plurality of spaced-apart rigid members encapsulated within said elongated bendable resilient cover, wherein said spaced-apart rigid members extend substantially transverse to the longitudinal axis of said elongated bendable cover and comprise a length sufficient to bridge said gap between said structural members, and at least one connecting member for connecting together at least two of said plurality of spaced-apart rigid members.

The bendable cover assembly has a thickness and sufficient elasticity to elastically deform to establish supporting contact between the marginal support areas of the cover assembly and the underlying horizontal structural members to provide a smooth transition over the gap or opening for pedestrian or vehicular traffic. Fasteners may be provided to elastically anchor the elongated bendable cover to at least one of the horizontal structural members.

Certain illustrative embodiments of the expansion joint system will now be described in greater detail with reference to the FIGURES. It should be noted that the expansion joint system is not intended to be limited to the illustrative embodiments shown in the FIGURES, but shall include all variations and modifications within the scope of the claims.

FIG. 1 shows a top plan view of an illustrative embodiment of the expansion joint cover assembly 10. Cover assembly 10 includes a plurality of spaced-apart members 11-25 defining a segmented central plate. The spaced-apart members 11-25 of the segmented central plate extend substantially perpendicular or transverse to the longitudinal axis of the cover assembly 10. The spaced-apart members 11-25 are connected by elongated connector members 26, 27. While the illustrative embodiment show in FIG. 1. shows the each of the spaced-apart members 11-25 being connected to connector members 26, 27, it should be noted that fewer than all of the spaced-apart members may be connected to the connector members 26, 27.

Figure 1A:
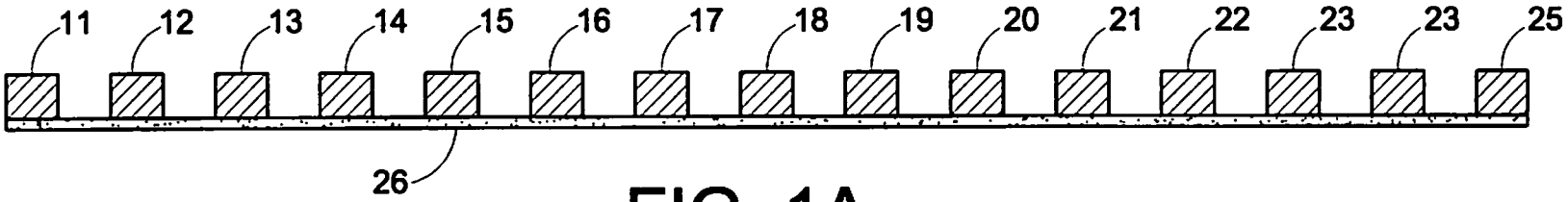
FIG. 1A is a cross-sectional view of one illustrative embodiment of the expansion joint cover assembly.

FIG. 1A shows a cross-section view of one illustrative embodiment of the expansion joint cover assembly of FIG. 1. Cover assembly 10 includes a plurality of spaced apart members 11-25 defining a segmented central plate. Elongated connector member 26 connects spaced apart members 11-25.

Figure 1B:
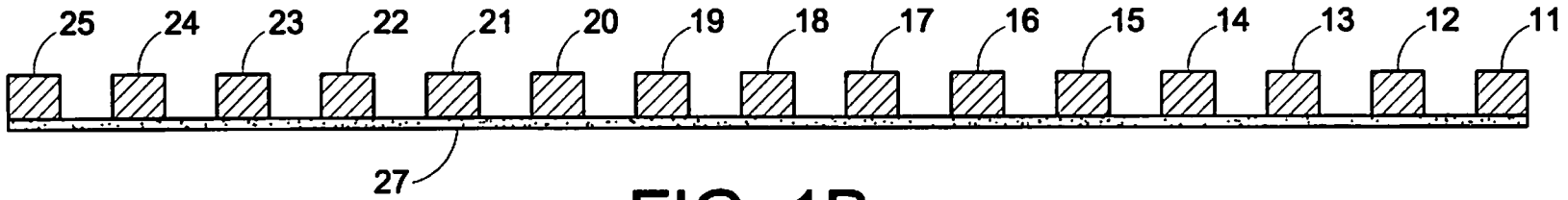
FIG. 1B is a cross-sectional view of one illustrative embodiment of the expansion joint cover assembly.

FIG. 1B shows a cross-section view of an illustrative embodiment of the expansion joint cover assembly of FIG. 1. Cover assembly 10 includes a plurality of spaced apart members 11-25 defining a segmented central plate. Elongated connector member 27 connects spaced apart members 11-25.

Figure 2:
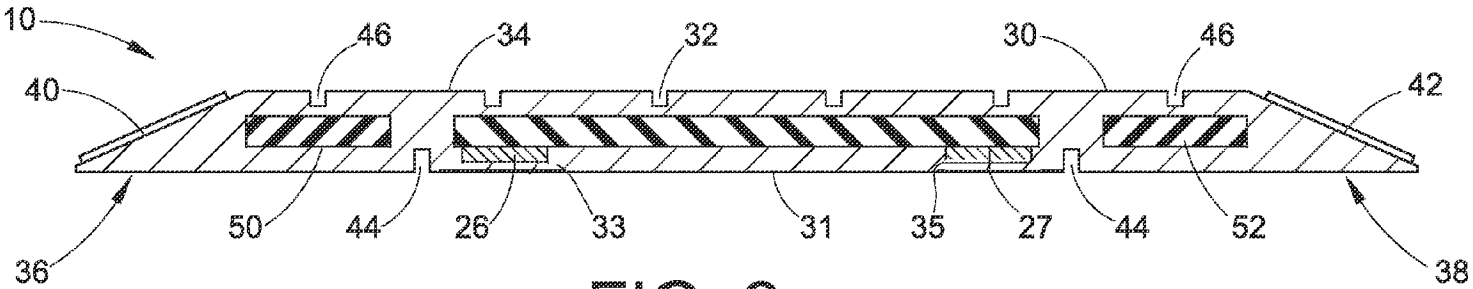
FIG. 2 is a cross sectional view of one illustrative embodiment of the expansion joint cover assembly.

FIG. 2 shows cross section view the expansion joint cover assembly 10. Cover assembly 10 includes a bendable cover 30. Bendable cover 30 has the form of a flexible, elastic strip like member having an upwardly directed load bearing face surface 32 with spaced apart upstanding ribs 34 arranged to extend transversely to the direction of traffic. The opposite lateral terminal edges 36, 38 of the cover 30 have tapered face surfaces 40, 42 for providing inclined planes for smoothing the transition from the traffic bearing face surface of one structural member to the cover assembly 30 and then from the cover assembly 30 to the traffic bearing face surface of another structural member. Cover 30 further includes bend or flex points 44, 46 to permit the cover assembly 10 to bend in response to movement of the underlying structural members.

Still referring to FIG. 2, the plurality of the spaced-apart members 11-25 of the segmented central plate is shown encapsulated within the cover 30. The bottom wall 31 of the cover 30 includes recessed regions 33, 35 to accommodate connector members 26, 27. According to the illustrative embodiment shown in FIG. 2, two side plate members 50, 52 are positioned on opposite lateral sides of the plurality of spaced-apart members 11-25. According to this embodiment, the side plates 50, 52 are shown positioned in a substantially parallel in relation to the plurality of spaced-apart members 11-25 of the central plate of the cove assembly 10. Like plate members 11-25, side plate members 50, 52 are encapsulated within cover 30. The segmented central plate member comprised of the plurality of spaced-apart members 11-25 is encapsulated within the cover 30 at a central position to overlie a gap between two structural members and forms a bridge to transfer the weight of traffic to the structural members.

Figure 2A:
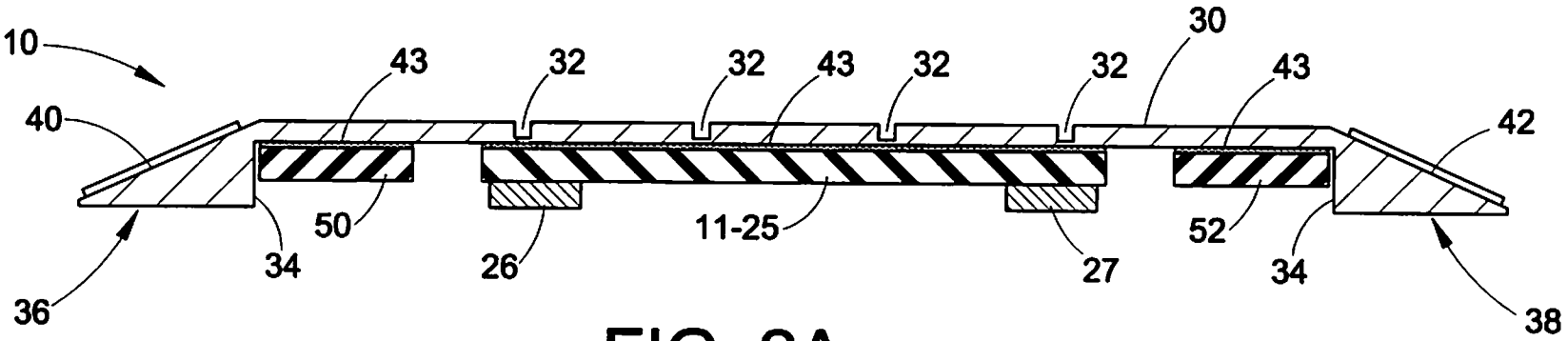
FIG. 2A is a cross-sectional view of one illustrative embodiment of the expansion joint cover assembly.

FIG. 2A shows cross-section view of one illustrative embodiment of the expansion joint cover assembly 10. Cover assembly 10 includes a bendable cover 30. Bendable cover 30 has the form of a flexible, elastic strip like member having an upwardly directed load bearing face surface 32. The opposite lateral terminal edges 36, 38 of the cover 30 have tapered face surfaces 40, 42 for providing inclined planes for smoothing the transition from the traffic bearing face surface of one structural member to the cover assembly 30 and then from the cover assembly 30 to the traffic bearing face surface of another structural member. The plurality of the spaced-apart members 11-25 of the segmented central plate is shown within the cover 30. According to the illustrative embodiment shown in FIG. 2A, two side plate members 50, 52 are positioned on opposite lateral sides of the plurality of spaced-apart members 11-25. According to this embodiment, the side plates 50, 52 are shown positioned in a substantially parallel in relation to the plurality of spaced-apart members 11-25 of the central plate of the cove assembly 10. In one illustrative embodiment, plate members 50, 52, and 11-25 are adhered by a mass of adhesive 43 to the recessed face surface 34. Plate members 11-25, side plate members 50, 52 and connecting members 26, 27 bordered by edge 34. The segmented central plate member comprised of the plurality of spaced-apart members 11-25 within the cover 30 at a central position to overlie a gap between two structural members and forms a bridge to transfer the weight of traffic to the structural members.

Figure 3:
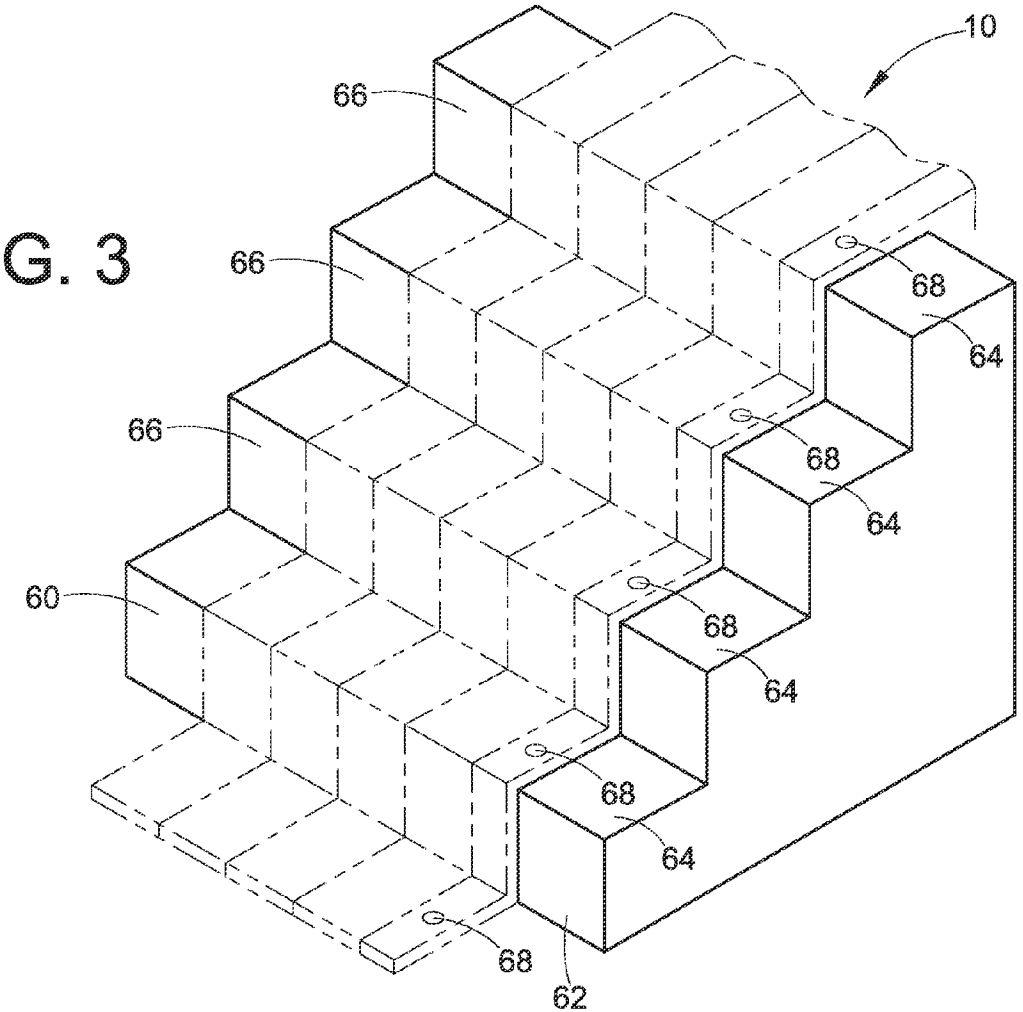
FIG. 3 is a perspective view of one illustrative embodiment of the expansion joint cover assembly installed over a tread and riser construction.

Now referring to FIG. 3, underlying structural members 60 and 62 include tread 64 for and riser 66 segments. The structural members are positioned to in such a manner so as to create a gap between the two members. The structural members may take the form of precast slabs. The structural members may be supported by underlying superstructure, which not shown. In sports stadiums, the construction of tread and riser walkways is designed to accommodate mechanical vibration often generated by enthusiastic fans as well as dimensional changes responsive to seismic cycling and temperature variations. The cover assembly 10 is shown in a bent condition and traverses several tread and riser segments.

Still referring to FIG. 3, the cover assembly 10 embodying a construction of parts, includes an elongated bendable cover 30 placed to overlie a joint gap and to extend along opposite lateral sides of the gap between two structural members. The cover 30 may have a predetermined extended length suitably selected to allow convenient handling and installation and, as shown in FIG. 3. The cover 30 includes suitable openings 68 arranged at spaced apart locations along at least one edge of the cover 30 for accepting a fastener for fastening the cover 30 to the underlying structural members. Without limitation, the anchoring fasteners may include screws, nails, rivets, and the like.

The rigid members of the segmented central plate and the side plate members may be rolled steel, stainless steel, galvanized steel and aluminum plates. The plate members 11-25, 50, and 52 may be galvanized steel plates at least three or four inches wide and having a thickness to impart mass to the cover for assuring a seated engagement with opposite lateral sides of the structural members.

The cover 30 may be constructed from elastic material, for example, extruded rubber, such that spaced apart openings along the edge of the cover are uninhibited from elastic deformation to prevent dislodgment and breakage of the fasteners. The elastic construction of the cover 30 is also chosen to insure that the cover will elastically conform into supporting contact with the underlying support structures, which can have irregular configurations without the loss of supporting contact. This insures stability to the cover 30 which is enhanced by the mass represented by the weight of the segmented central plate 11-25 and side plates 50, 52.

According to certain illustrative embodiments, the cover 30 is constructed of elastomeric material containing fillers and a precisely chosen amount of a plasticizer to yield a rubber material having a durometer reading of about 80. The term "elastomeric" refers for a material that possess rubber-like properties, for example, an elastomeric material will substantially recover its original dimensions after compression and/or elongation. Any elastomeric material may be used to prepare the resilient cover 30 of the present invention, so long as the cover 30 can be prepared to a thickness and sufficient elasticity to elastically deform to establish supporting contact between the marginal support areas of the cover assembly and the underlying horizontal structural members to provide a smooth transition over the gap or opening for pedestrian or vehicular traffic.

Suitable elastomeric materials used to prepare the resilient cover 30 include, but should not be limited to, styrene-butadiene rubber (SBR), butadiene rubber (BR), butyl rubber, ethylene-propylene rubber (EPM), ethylene-propylene-diene rubber (EPDM), polyisoprene rubber, polychloroprene rubber, various ethylene-alkene copolymer rubbers, silicon rubber, nitrile rubber, and blends thereof. According to illustrative embodiments, an ethylene-propylene-diene rubber (EPDM) is utilized to prepare the cover 40 of the present invention. A particularly suitable EPDM rubber composition that is useful to prepare the cover 40 is commercially available from Advanced Elastomer Systems, L.P. (Akron, Ohio).

Also disclosed is a method of installation of a cover assembly to bridge a gap or opening between two spaced structural members. According to certain embodiments, the method for the installation of a cover assembly to bridge a gap formed by an expansion joint between two structural members involves applying the above-described cover assembly across a gap formed between two spaced-apart structural members in a tread and riser application.

The cover assembly may be used to bridge an opening or gap between any two structural members to create a smooth traffic transition between the two structural members. The cover assembly is particularly useful to bridge an opening or gap between vertically offset structural members. For example, the cover assembly can be used to bridge structural members, such as concrete slabs, which are designed to be vertically offset or that may become vertically offset or displaced due to differential concrete settlement.

As described hereinabove, it is widely known that surface of concrete structural members are not entirely uniform, and are often not produced with square or smooth surfaces. These concrete structural members are usually rough, often have substantially irregular or undulating gaps, or are missing entire chunks of concrete. Metal plates have been traditionally used in cover plate assemblies, but cannot conform to the contours of the concrete structural members and, therefore, a potentially dangerous hazard exists for pedestrian and vehicular traffic. The cover assembly is prepared from an elastomeric resilient material than can be elastically deformed, in response to a load applied to it, to conform to the irregular or undulating contours present often found in structural members. The cover assembly provides a means a smooth the transition across the irregular surfaces of the structural members and to substantially eliminate the hazards associated with the irregular surface of structural members.

While the expansion joint cover assembly has been described above in connection with the certain illustrative embodiments, as shown in the various Figures, it is to be understood that other similar embodiments may be used or modifications and additions may be made to the described embodiments for performing the same function of the expansion joint system without deviating therefrom. Further, all embodiments disclosed are not necessarily in the alternative, as various embodiments may be combined to provide the desired characteristics. Variations can be made by one having ordinary skill in the art without departing from the spirit and scope of the disclosure.

The invention claimed is:

1. A bendable expansion joint cover assembly for a gap between two structural members comprising:

an elongated bendable cover wherein said elongated bendable cover has a predetermined width sufficient to overlie portions of said structural members outwardly of marginal edges to a gap between said structural members and peripheral edges including tapered face surfaces for providing incline plates to bear traffic traversing the cover;

a segmented central plate comprising a plurality of spaced-apart rigid members engaged with said elongated bendable resilient cover, wherein each of said spaced-apart rigid members extend substantially transverse to the longitudinal axis of said elongated bendable cover and comprise a length sufficient to bridge said gap between said structural members, and at least one elongated connecting member extending along said longitudinal axis of said elongated bendable cover for connecting together at least two of said plurality of spaced-apart rigid members; wherein said at least one connecting member comprises a perforated connecting member.

2. The expansion joint cover assembly of claim 1, wherein said elongated bendable cover comprises a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members.

3. The expansion joint cover assembly of claim 2, wherein said cover assembly further comprises plate members engaged with said elongated bendable cover and extending along opposite lateral sides of said plurality of rigid members.

4. The expansion joint cover assembly of claim 3, wherein said at least one connecting member and lateral side plate members are perforated.

5. The expansion joint cover assembly of claim 3, wherein said cover elastically deforms to apply a biasing force in a direction to urge opposite lateral sides of said cover toward the structural members while being resiliently deformed by traffic traversing said traffic bearing surface.

6. The expansion joint cover assembly of claim 3, wherein said plate members extending along opposite lateral sides of said plurality of rigid members comprise a perforated metal, a perforated metal alloy, a perforated polymer material, or a perforated composite material.

7. The expansion joint cover assembly of claim 6, wherein said plate members extending along opposite lateral sides of said plurality of rigid members comprise a perforated metal alloy.

8. The expansion joint cover assembly of claim 2, comprising a least one fastener engaged with said cover along at least one lateral side portion of said cover for elastically anchoring said elongated resilient cover to at least one of the horizontal structural members.

9. The expansion joint cover assembly of claim 8, comprising a plurality of fasteners engaged with said cover at spaced apart sites along at least one lateral side portion of said cover for elastically anchoring said elongated resilient cover to at least one of the horizontal structural members.

10. The expansion joint cover assembly of claim 9, wherein said fasteners comprise mechanical fasteners.

11. The expansion joint cover assembly of claim 10, wherein said mechanical fasteners includes at least one of nails, screws, rivets and/or tacks.

12. The cover assembly of claim 1, wherein said elongated resilient cover includes thickened peripheral edges defining a border to a recessed face surface, said face surface supporting said rigid members.

13. The expansion joint cover assembly of claim 1, wherein said elongated bendable cover includes thickened peripheral edges defining a border to a recessed face surface, said face surface supporting said plurality of spaced-apart rigid members, and said at least one connecting member extending along the opposite lateral sides of said plurality of spaced-apart rigid members.

14. The cover assembly of claim 1, wherein said load bearing surface includes spaced apart upstanding ribs arranged to extend transversely to the direction of traffic traversing the cover.

15. The expansion joint cover assembly of claim 1, wherein said at least one connecting member comprises a perforated metal or a perforated metal alloy.

16. The expansion joint cover assembly of claim 1, comprising bend or flex points.

17. A bendable expansion joint cover assembly for a gap between two structural members comprising:

an elongated bendable cover wherein said elongated bendable cover has a predetermined width sufficient to overlie portions of said structural members outwardly of marginal edges to a gap between said structural members and peripheral edges including tapered face surfaces for providing incline plates to bear traffic traversing the cover;

a segmented central plate comprising a plurality of spaced-apart rigid members encapsulated within said elongated bendable resilient cover, wherein each of said spaced-apart rigid members extend substantially transverse to the longitudinal axis of said elongated bendable cover and comprise a length sufficient to bridge said gap between said structural members; and at least one elongated connecting member extending along said longitudinal axis of said elongated bendable cover for connecting together at least two of said plurality of spaced-apart rigid members; wherein said at least one connecting member comprises a perforated connecting member.

18. The expansion joint cover assembly of claim 17, wherein said elongated bendable cover comprises a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members.

19. The expansion joint cover assembly of claim 18, wherein said cover assembly further comprises plate members engaged with said elongated bendable cover and extending along opposite lateral sides of said plurality of rigid members.

20. The expansion joint cover assembly of claim 19, wherein said at least one connecting member and lateral side plate members are perforated.

21. The expansion joint cover assembly of claim 19, wherein said cover elastically deforms to apply a biasing force in a direction to urge opposite lateral sides of said cover toward the structural members while resiliently deformed by traffic traversing said traffic bearing surface.

22. The expansion joint cover assembly of claim 19, wherein said plate members extending along opposite lateral sides of said plurality of rigid members comprise a perforated metal, a perforated metal alloy, a perforated polymer material, or a perforated composite material.

23. The expansion joint cover assembly of claim 22, wherein said plate members extending along opposite lateral sides of said plurality of rigid members comprise a perforated metal alloy.

24. The expansion joint cover assembly of claim 18, comprising a least one fastener engaged with said cover along at least one lateral side portion of said cover for elastically anchoring said elongated resilient cover to at least one of the horizontal structural members.

25. The expansion joint cover assembly of claim 24, comprising a plurality of fasteners engaged with said cover at spaced apart sites along at least one lateral side portion of said cover for elastically anchoring said elongated resilient cover to at least one of the horizontal structural members.

26. The expansion joint cover assembly of claim 25, wherein said fasteners comprise mechanical fasteners.

27. The expansion joint cover assembly of claim 25, wherein said mechanical fasteners include at least one of nails, screws, rivets and/or tacks.

28. The cover assembly of claim 17, wherein said elongated resilient cover includes thickened peripheral edges defining a border to a recessed face surface, said face surface supporting said rigid members.

29. The expansion joint cover assembly of claim 17, wherein said elongated bendable cover includes thickened peripheral edges defining a border to a recessed face surface, said face surface supporting said plurality of spaced-apart rigid members, and said members extending along the opposite lateral sides of said plurality of spaced-apart rigid members.

30. The expansion joint cover assembly of claim 17, wherein said at least one connecting member comprises a perforated metal or a perforated metal alloy.

31. The expansion joint cover assembly of claim 17, comprising bend or flex points.

32. The cover assembly of claim 18, wherein said load bearing surface includes spaced apart upstanding ribs arranged to extend transversely to the direction of traffic traversing the cover.

33. An expansion joint comprising:

two spaced-apart structural members defining a gap therebetween; and an expansion joint cover assembly for a gap between two structural members comprising:

an elongated bendable cover wherein said elongated bendable cover has a predetermined width overlying portions of said structural members outwardly of marginal edges to a gap between said structural members;

a segmented central plate comprising a plurality of spaced-apart rigid members engaged with, or encapsulated within, said elongated bendable resilient cover, wherein each of said spaced-apart rigid members extend substantially transverse to the longitudinal axis of said elongated bendable cover and comprise a length sufficient to bridge said gap between said structural members, and at least one elongated connecting member extending along said longitudinal axis of said elongated bendable cover for connecting together at least two of said plurality of spaced-apart rigid members; wherein said at least one connecting member comprises a perforated connecting member.

34. The expansion joint of claim 33, wherein said elongated bendable cover comprises a load bearing surface and a support surface opposite the load bearing surface and marginal support areas along opposite lateral edges thereof, said cover having a thickness and sufficient elasticity to elastically deform for establishing supporting contact between said marginal support areas and said structural members adjacent to a gap between said structural members.

35. The expansion joint of claim 34, wherein said cover assembly further comprises plate members engaged with said elongated bendable cover and extending along opposite lateral sides of said plurality of rigid members.

36. The expansion joint of claim 35, wherein said plate members extending along opposite lateral sides of said plurality of rigid members comprise a perforated metal, a perforated metal alloy, a perforated polymer material, or a perforated composite material.

37. The expansion joint of claim 35, wherein said at least one connecting member and lateral side plate members are perforated.

38. The expansion joint cover assembly of claim 34, comprising a least one fastener engaged with said cover along at least one lateral side portion of said cover for elastically anchoring said elongated resilient cover to at least one of the horizontal structural members.

39. The expansion joint of claim 33, wherein said at least one connecting member comprises a perforated metal or a perforated metal alloy.

40. The expansion joint of claim 33, comprising bend or flex points.

41. A bendable expansion joint cover assembly for a gap between two structural members comprising:

an elongated bendable cover wherein said elongated bendable cover has a predetermined width sufficient to overlie portions of said structural members outwardly of marginal edges to a gap between said structural members and peripheral edges including tapered face surfaces for providing incline plates to bear traffic traversing the cover;

a segmented central plate comprising a plurality of spaced-apart rigid members engaged with said elongated bendable resilient cover, wherein each of said spaced-apart rigid members extend substantially transverse to the longitudinal axis of said elongated bendable cover and comprise a length sufficient to bridge said gap between said structural members, and at least one elongated connecting member extending along said longitudinal axis of said elongated bendable cover for connecting together at least two of said plurality of spaced-apart rigid members wherein said elongated connecting member comprises a perforated metal, a perforated metal alloy, a perforated polymer material, or a perforated composite material.

* * * * *